United States Patent [19]

Meinecke et al.

[11] Patent Number: 4,988,410

[45] **Date of Patent: * Jan. 29, 1991**

[54] PRESS SECTION WITH TWO EXTENDED NIP PRESSES FOR THE PRODUCTION OF A FIBROUS WEB

[75] Inventors: Albrecht Meinecke, Heidenheim; Karl Steiner, Herbrechtingen, both of Fed. Rep. of Germany

[73] Assignee: J. M. Voith GmbH, Fed. Rep. of Germany

[ * ] Notice: The portion of the term of this patent subsequent to May 8, 2007 has been disclaimed.

[21] Appl. No.: 347,762

[22] Filed: May 5, 1989

[30] Foreign Application Priority Data

May 5, 1988 [DE] Fed. Rep. of Germany ..... 3815278

[51] Int. Cl.[5] ..... D21F 3/04

[52] U.S. Cl. ..... 162/360.1; 162/358

[58] Field of Search ..... 162/205, 305, 358, 360.1

[56] References Cited

U.S. PATENT DOCUMENTS

| | | | |
|---|---|---|---|
| 4,188,262 | 2/1980 | Kankaanpaa | 162/360.1 |
| 4,201,624 | 5/1980 | Mohr et al. | 162/205 |
| 4,483,745 | 11/1984 | Wicks et al. | 162/360.1 |
| 4,586,984 | 5/1986 | Laapotti | 162/205 |
| 4,625,376 | 12/1986 | Schiel et al. | 29/119 |
| 4,643,802 | 2/1987 | Schiel | 162/358 |
| 4,661,206 | 4/1987 | Heitmann et al. | 162/358 |
| 4,691,420 | 9/1987 | Schiel et al. | 29/116 R |
| 4,704,192 | 11/1987 | Cronin | 162/360.1 |
| 4,704,776 | 11/1987 | Watanabe et al. | 29/132 |
| 4,923,570 | 5/1990 | Steiner | 162/358 |

FOREIGN PATENT DOCUMENTS

| | | | |
|---|---|---|---|
| 3030232 | 2/1982 | Fed. Rep. of Germany | 162/358 |
| 3317457 | 11/1984 | Fed. Rep. of Germany | 162/358 |
| 3742848A1 | 6/1989 | Fed. Rep. of Germany . | |
| 2106557 | 4/1983 | United Kingdom | 162/358 |
| 88/08051 | 10/1988 | World Int. Prop. O. | 162/360.1 |

*Primary Examiner*—Karen M. Hastings

*Attorney, Agent, or Firm*—Ostrolenk, Faber, Gerb & Soffen

[57] ABSTRACT

A press section of a paper machine is of the type having two extended press nips (27, 37) disposed one behind the other, which are each formed by a press roll (21, 31) and by a flexible rotating press member (28) which can be pressed against the press rolls by means of a press shoe (27, 37). The paper web which is to be dewatered passes through the first extended press nip between two endless felt belts (11, 13).

In accordance with the invention, the paper web runs through the second extended press nip together with only one (11 or 13) of the two felt belts. As a result the paper web (9) comes into contact with the smooth outer surface of the second press roll. Because of this arrangement the flexible press member can have a rough outer surface formed, for example, by the joggles of a reinforcing fabric.

10 Claims, 3 Drawing Sheets

PRESS SECTION WITH TWO EXTENDED NIP PRESSES FOR THE PRODUCTION OF A FIBROUS WEB

BACKGROUND OF THE INVENTION

1. Field of the Invention

The invention relates to a press section for a machine for the production of a fibrous web, in particular a paper web. In particular it concerns a press section having two extended press nips, with each extended press nip being formed in a known way by a rotatable press roll and by a rotating flexible press member, which can be pressed against the press roll by means of a press shoe.

2. Description of Related Art

The special features of known long-nip presses are as follows: The press nip is areal, and not substantially linear as in conventional roll presses. As a result in the press nip the still wet paper web is subject to pressing pressure over a relatively long distance and its dewatering is consequently more intensive. Furthermore the pressure in the press nip does not occur suddenly, but it can be continuously brought from a lower value to a high value. There is consequently the danger of the paper web becoming crushed in the press nip.

In a previously suggested two-nip press section both long-nip presses are constructed as double felt presses. I.e., each time the paper web passes through each extended press nip between two felt belts. This arrangement has proved successful in machines for the manufacture of relatively thick paper webs (size: 100–200 g/m$^2$). However satisfactory values for the dry solids content have not been achieved in the manufacture of relatively thin paper grades.

SUMMARY OF THE INVENTION

Therefore the object of the invention is to provide a press section having two extended press nips which is particularly suitable for manufacturing thin paper grades (size 40 to 100 g/m$^2$). In particular with this press section it will be possible to achieve a higher dry solids content than before.

This object is achieved by a press section of a machine for producing a fibrous web having two extended press nips disposed one behind the other in the direction of travel of the web; in which each of the two extended press nips is formed by a press roll and by at least one flexible rotating press member, which can be pressed against the press roll by a respective press shoe; in which two endless felt belts are provided to guide the paper web to be dewatered into the first extended press nip; and wherein the paper web to be dewatered is guided into the second extended press nip by only one endless felt belt. In this press section, the paper web from which water is to be removed passes through the first extended press nip between two felts and subsequently passes through the second extended press nip with just a single felt.

The invention is based on the following realisations: On the one hand the dewatering of relatively thin paper webs in an extended press nip is surprisingly more intensive if only a single felt passes with it through the press nip. On the other hand a substantially improved surface quality is however achieved if the paper web passes through an extended press nip between two felts. The arrangement specified by the invention therefore represents a compromise, which enables both high surface quality and also satisfactory values for the dry solids content to be achieved. With the compromise solution specified by the invention, the first extended press nip is always double-felted and the second extended press nip is single-felted, and as a result it is possible to pass the paper web between the two extended press nips without an open paper draw, so that an unwanted longitudinal expansion of the paper web between the two press nips is avoided.

In fact a similar arrangement is already known from U.S. Pat. No. 4,586,984 (Laapotti), FIG. 2. Herein a single central press roll together with two flexible rotating press belts forms two extended press nips disposed one behind the other. Each of the press belts passes over several rolls so that it is not possible to seal the interior at the front side. It also makes the presence of just a single press roll necessary so that the paper web passes through the second press nip between one of the felts and one of the press belts. As a result the second press belt has to have a smooth outer surface.

On the other hand the arrangement specified by the invention enables a flexible press member of the conventional, reliable design to be used not only in the first, but also in the second, press nip. For this design it is characteristic that it has a rough outer surface. In other words: Known press jackets, which are produced by coating a wire belt with plastic material on just one side, can be used. (The manufacture of a press jacket which is smooth on both sides and which can come into direct contact with the paper web is in fact possible, but at present very expensive.) In this connection it is preferred that the flexible press member has a rough outer surface, the press roll of the second nip has a smooth, non-absorbent jacket surface, and the paper web passes through the second extended press nip between one of the endless felt belts and the second press roll.

From U.S. Pat. No. 4,201,624 (Mohr et. al.) there is known an arrangement having a single central flexible press belt which can be urged against a first and a second press roll by means of a respective press shoe. As shown by FIG. 4 of this Patent Specification, the paper web passes through the two extended press nips between a single felt and the press belt. In this case the press belt therefore has to have a smooth outer surface. A further disadvantage lies in that in both press nips the same paper side is in contact with the press belt. Consequently there is the danger that the surface quality of the finished paper is unequal on the upper and lower sides. As shown in FIG. 5, the paper web passes through the first extended press nip between two felts and through the second extended press nip between a felt and a press roll jacket. However there is the disadvantage that the paper web remains behind the first extended press nip over a long distance between the two felts, and consequently an intensive rewetting of the paper web is feared.

According to a further feature, in the first extended press nip, the press roll is disposed beneath the flexible press member and the flexible press member is constructed as an inflatable press jacket closed at the front end. This feature has at least the following advantages: The lower first press roll, which will generally be equipped with recesses for the temporary storage of water, as is known, can absorb a relatively large amount of water from the paper web through the lower felt of the first press nip and transport it in the downward direction. The water can be collected in the lower region of this press roll and be drained away laterally. Of course the lower felt also transports a certain quantity of water in the downward direction, which is drained away at this place. However it is essential—thanks to the downward direction of transport—that a relatively large quantity of water can be drained away. However it was not actually possible to realise this arrangement until the flexible press member disposed above the press roll (with the operating direction of the press shoe being from the top to the bottom) was constructed as an inflatable press jacket closed at the front end. For only with this arrangement is it possible to safely prevent the lubricant required to lubricate the press shoe laterally escaping to the outside.

The use of an inflatable press jacket closed at the front end is also recommended if the flexible press member is disposed beneath the press roll, with the operating direction of the press shoe being from the bottom in the upward direction. A particularly advantageous construction of an inflatable press jacket closed at the front end is known from U.S. Pat. No. 4,625,376 to Schiel et al. (Voith file P 4164).

The application discloses and claims relate to advantageous refinements of the invention. One of the advantages is that in total only two felt belts are required, which jointly pass through the first press nip and then only one felt belt passes through the second press nip.

One alternative form of the invention provides a particularly space-saving method of construction. For the two extended press nips, there is only a single long-nip press unit, which has only a single press member in the form of an inflatable press jacket closed at the front end; and two press shoes, each of which is assigned to one of the two press rolls; and the paper web to be dewatered is arranged to pass together with one of the two felt belts and together with the press jacket; but without the lower felt belt, from the first press nip to the second press nip. Similar compact arrangements are in fact already known, but only with completely conventional press rolls, i.e. without a long-nip press unit. When compared with these known compact arrangements there is the advantage that a suction press roll is no longer required; it is now replaced by a long-nip press unit.

BRIEF DESCRIPTION OF THE DRAWINGS

Other objects, features and advantages of the invention will now be explained in connection with several preferred embodiments of the invention, with reference to the drawings in which.

DETAILED DESCRIPTION OF THE PREFERRED EMBODIMENTS

Figure 1:
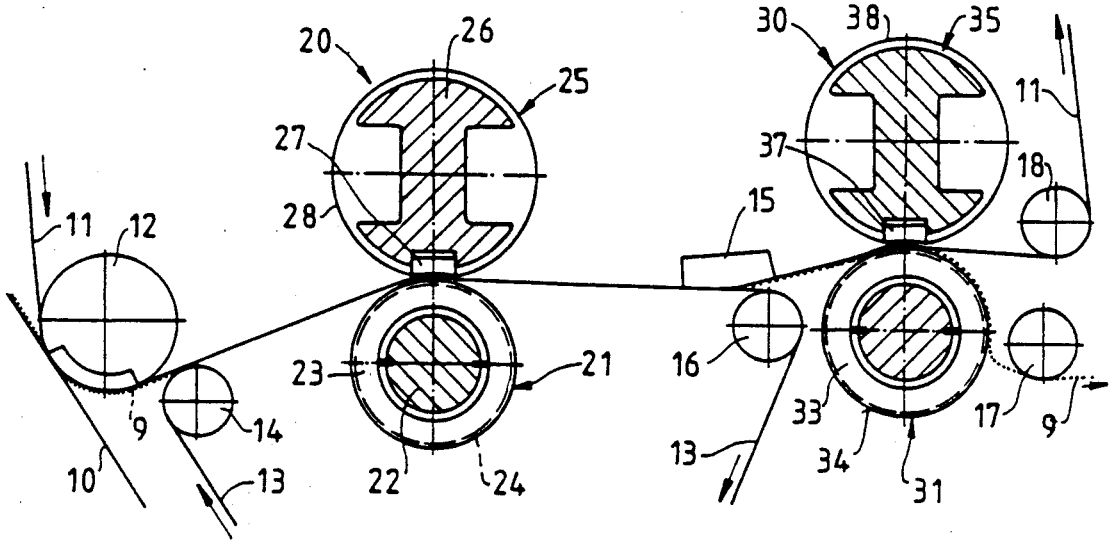
FIGS. 1 to 3, 5 and 6 each show a respectively different press section in a diagrammatical side elevation.
Figure 2:
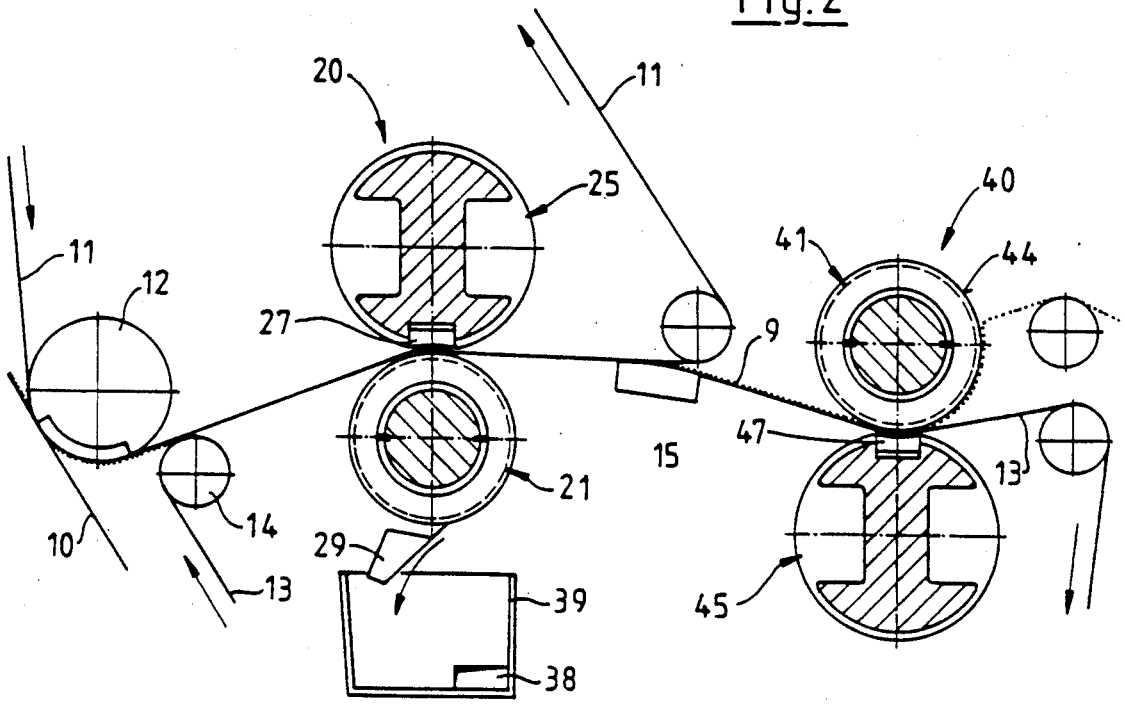
Figure 3:
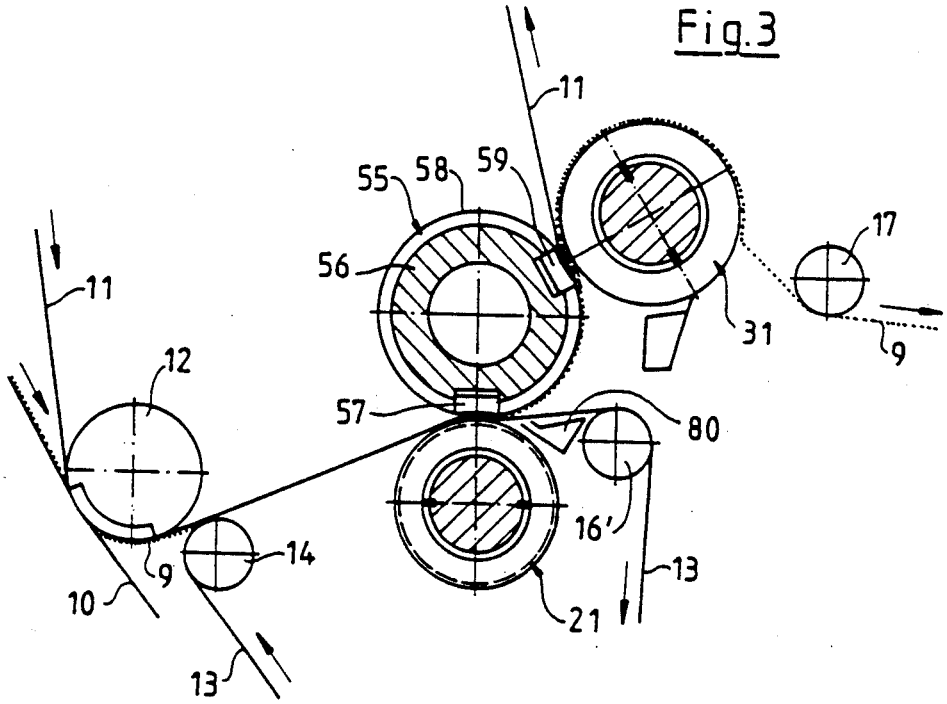

From a wire section in which a paper web 9 is formed in a known way, just a short length of the endles wire belt 10 can be seen in FIGS. 1 to 3. A pick-up felt (or "upper felt") 11 arriving from above passes over a pick-up suction roll 12, and it picks up the paper web 9 from the wire belt 10. A lower felt 13 comes from below, and it passes over a guide roll 14 and then together with the paper web 9 and the pick-up felt 11 it passes through a first long-nip press 20 and from there to a separating suction device 15 lying on the pick-up felt 11. Instead of the separating suction box 15 shown, a different separating device may also be provided, e.g. a suction roll, a separating foil or similar. Here the pick-up felt 11 together with the paper web 9 is separated by this device from the lower felt 13, which proceeds downwards via a guide roll 16. The paper web 9 and the pick-up felt 11 now pass through a second long-nip press 30, and are separated at its outlet.

A press nip extended in the direction of travel of the web is formed in the first long-nip press 20 by a press roll 21 and by a long-nip press unit 25. The press roll 21 is constructed as a flexure-adjusting roll; i.e. it has a non-rotating bending beam 22 and a rotatable roll shell 23 hydraulically supported thereon. Its external shell surface preferably has a plurality of recesses for the temporary storage of water that has been forced out. These recesses, e.g. peripheral grooves or pocket drill holes, are shown symbolically by a broken circle 24.

The long-nip press unit 25 likewise has a non-rotating bending beam 26, and also a press shoe 27 hydraulically supported therein and a flexible press jacket 28, which rotates on a predominantly circular path around the bending beam and the press shoe. The press shoe has a sliding surface for the press jacket adapted to the shape of press roll 21, and can urge this press jacket against the press roll.

The components of the second long-nip press 30 are constructed substantially the same as the components of the first long-nip press 20; however they are generally designed for a greater pressing force. One important difference lies in the fact that the roll shell 33 of press roll 31 has a smooth surface 34 suitable for direct contact with the paper web 9. As is known, it is important that the still damp paper web 9 does not adhere too strongly to the roll surface after leaving the second press nip, but can be easily removed therefrom. The surface therefore has to be non-absorbent, i.e. water-repellent, as is the case, for example, with stone rolls or with rolls having determined plastic properties. Known rolls of this type are described in U.S. Pat. Nos. 4,691,420 and 4,704,776.

The paper web 9 is passed behind the second long-nip press 30, for example by means of a paper guide roll 17, to the subsequent drying section, not shown. The pick-up felt 11 passes over a felt guide roll 18 and further guide rolls, not shown, back to the pick-up suction roll 12.

In the exemplified embodiment shown in FIG. 2, the first long-nip press 20 is constructed exactly the same as the long-nip press in FIG. 1. However the second long-nip press 40 has the reverse arrangement of the second long-nip press 30 in FIG. 1. Whereas in FIG. 1 the press roll 31 is disposed underneath the long-nip press unit 35 (operating direction of the press shoe 37 from above in the downward direction), in FIG. 2 the press roll 41 is disposed above the long-nip press unit 45, with the operating direction of the press shoe 47 being from below in the upward direction. Press roll 41 also has a smooth roll shell surface 44 suitable for direct contact with paper web 9. Therefore in FIG. 2 the arrangement is such that the paper web 9 does not pass through the second long-nip press 40 together with upper pick-up felt 11, but together with lower felt 13. Therefore in FIG. 2 the separating member 15 lies on the lower felt 15 so that the paper web is separated here from the pick-up felt 11 and travels on with the lower felt.

In both FIGS. 1 and 2 the pressing plane is disposed substantially vertically in both long-nip presses 20 and 30 or 20 and 40 respectively. In this connection it is however expedient that the path of the paper web rises slightly towards the first long-nip press 20, so that it touches the shell 23 of the first press roll 21 before entering the press nip. This also applies in the case of the second long-nip press 30 in FIG. 1, because here the press roll 31 also lies beneath the long-nip press unit 35. On the other hand in FIG. 2 the path of paper web 9 with lower felt 13 is inclined slightly downwards in front of the second long-nip press 40 because here the press roll 41 lies above the long-nip press unit 45.

As is shown by the example of the first press roll 21 of FIG. 2, all the exemplified embodiments have a water doctor blade 29 and a water collection trough 39 with a laterally connected discharge line 38 on the lower side of first press roll 21.

FIG. 3 shows a space-saving double press arrangement. For the two extended press nips only a single long-nip press unit 55 is provided, with a non-rotating bending beam 56 (which is only shown by way of example as a roll-shaped hollow beam). In bending beam 56 two press shoes are hydraulically supported, with one press shoe 57 operating in the downward direction and one press shoe 59 operating in the diagonally upward direction. A press jacket 58 passes successively through both press nips. Lower press roll 21 corresponds exactly to press roll 21 in FIG. 1. Upper press roll 31 corresponds in exactly the same way to press roll 31 of FIG. 1; only the position of installation and the operating direction are different, in accordance with the diagonally upward operating direction of upper press shoe 59.

The paper web firstly passes exactly as shown in FIG. 1 between pick-up felt 11 and lower felt 13 through the first press nip (between lower press roll 21 and lower press shoe 27). Subsequently the paper web 9 together with pick-up felt 11 and with press jacket 58, but without lower felt 13, travels upwards and through the second press nip. Lower felt 13 is separated from the paper web a short distance behind the lower press nip and travels over a guide roll 16' in the downward direction. At the outlet of the upper press nip the paper web 9 is separated from the pick-up felt 11 and passes over the upper half of the periphery of the upper press roll 31 to the place where it is removed by means of a paper guide roll 17 from the upper press roll.

Figure 4:
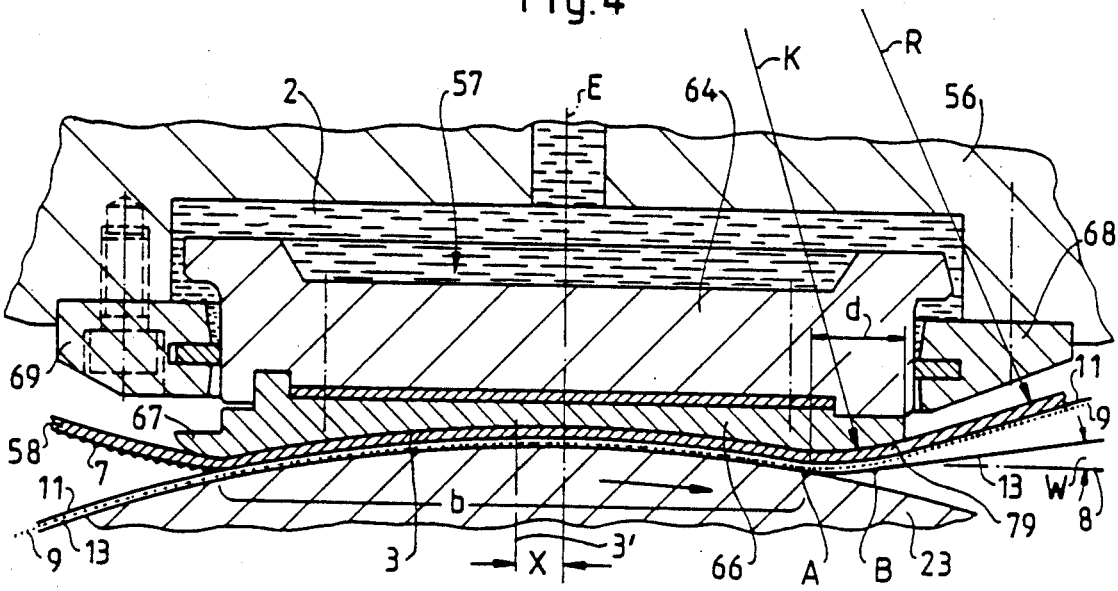
FIG. 4 shows a detail of FIG. 3 on an enlarged scale.

So that the paper web 9 at the outlet of the first, lower press nip travels safely upwards with pick-up felt 11 (and does not travel on with lower felt 13), the lower press shoe 57 can be specially designed as shown in detail in FIG. 4. In addition an air-blast box 80 can be provided in the outlet wedge between lower felt 13 and press roll 21.

FIG. 4 shows that press shoe 57 is constructed in two parts; i.e. it is divided into an upper part 64 and a lower part 66. In its function as a piston, the upper part—seen in cross section—is disposed substantially symmetrically to the pressing plane E and in pressure chamber 2. The lower part 66 comprising the sliding surface 3 is in contrast unsymmetrical to pressing plane E. For this purpose it has—seen in cross section—an extension 67 on the inlet side which is located substantially inside the circular path of press jacket 58. The centre" of sliding surface 3 is consequently offset by the dimension x from pressing plane E contrary to the direction of travel of press jacket. The packing strips with their supports used to guide press shoe 57 and to seal pressure chamber 2 are designated by 68 and 69. At the inlet side can be seen the two felts 11 and 13 and the paper web 9 located between them. It can also be seen that press jacket 58 has a rough outer surface formed, for example, by the joggles of a reinforcing web and symbolically shown at 7.

At the outlet side, i.e. in FIG. 4 to the right of sliding surface 3 (the width of which is b), the lower part 66 of the press shoe has a convexly curved guide surface 79 for press jacket 58. The radius of curvature K of this guide surface may be approximately equal to the radius R of the circular path of press jacket 58; however it may also be smaller than radius. The curvature of guide surface 79—seen in cross section in FIG. 4—is preferably uniform. However there may also be exceptions to this, e.g. a short central part may be flat. As can be seen, the lower felt 13 passes from the outlet end A of the press nip together with paper web 9, upper felt 11 and press jacket 58 for a considerable distance over the guide surface 79. Not until point B is reached, i.e. a short distance in front of the outlet end of the press shoe lower part 66, is the lower felt 13 separated from the paper web 9. Between points A and B air can enter lower felt 13, with the result that paper web 9 is safely detached from lower felt 13 at point B and travels with upper felt 11 and press jacket 58. The length required for the distance between A and B and consequently the length of guide surface 79 (measured in the direction of travel of the web) should be determined by experiments. On the one hand the distance between A and B is made as short as possible so as to keep the rewetting of the paper web 9 by lower felt 13 to a minimum. On the other hand the lower felt 13 has to be given enough time for ventilation. The length of the distance between A and B should therefore be made a function of, inter alia, the felt porosity and the moisture with which lower felt 13 enters the press nip.

As can be seen from FIG. 4, the length of the distance between A and B can be determined by varying angle w between lower felt 13 and the plane 8 at right angles to pressing plane E. Length d of guide surface 79 of press shoe 57 and its shape (e.g. radius of curvature K) will be chosen so that point B always lies in the region where press jacket 58 is still in contact with guide surface 79.

The refinement shown in FIG. 4 may not just be used on press shoe 57 shown in FIG. 3, but also on press shoe 27 of the first long-nip press 20, in particular in FIG. 1 (and possibly in FIG. 2 as well). As a result separating member 15 is omitted. The rewetting of the paper web is also reduced because lower felt 13 is detached much earlier from paper web 9 than in FIG. 1.

Figure 5:
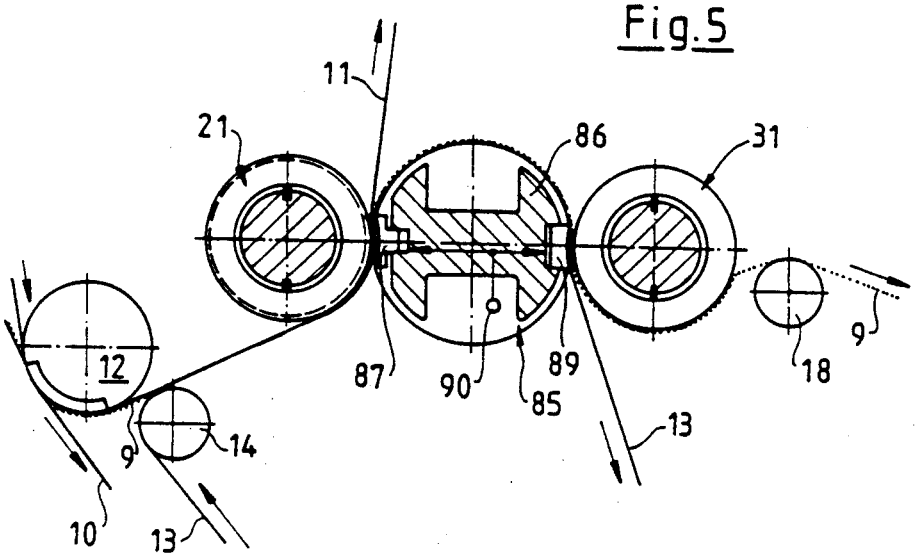
Figure 6:
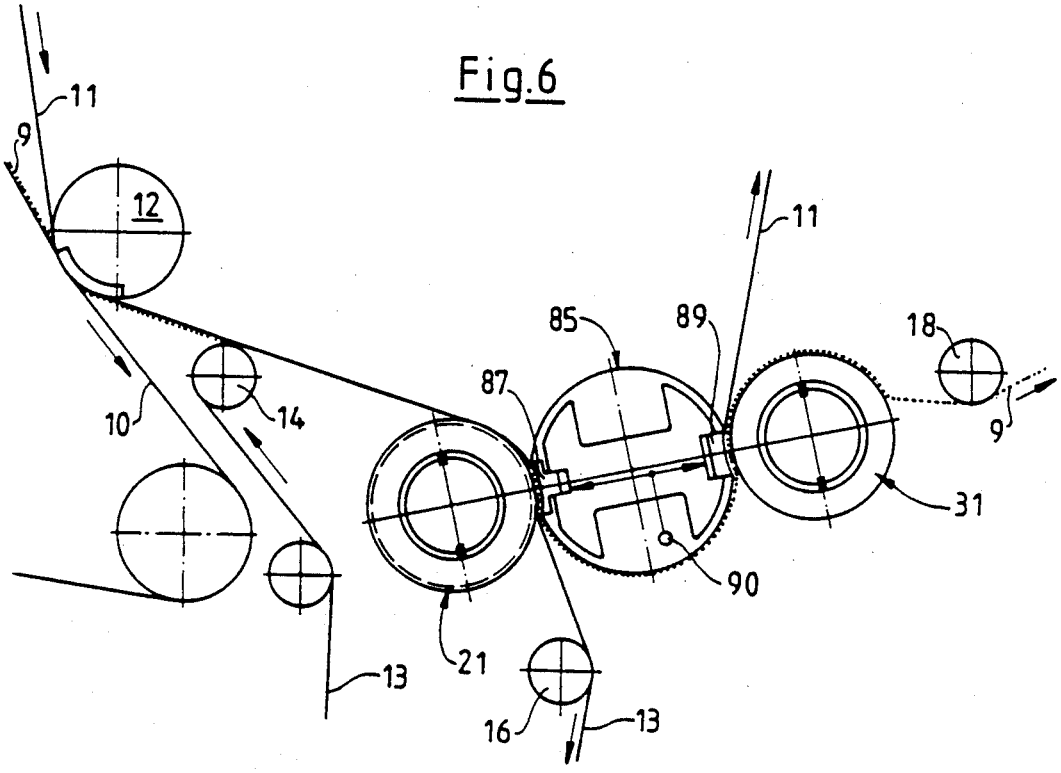

FIGS. 5 and 6 show two double-press arrangements each having a central long-nip press unit 85, in which the median planes of the two extended press nips coincide in a mutual pressing plane, in which the axes of the two press rolls 21 and 31 also lie. The flexure of bending beam 86 is reduced thereby. The mutual pressing plane may be horizontal as in FIG. 5 or may be chosen as required, e.g. vertically or sloping upwards, as shown in FIG. 6. The rotating press jacket is designated by 88.

As shown in FIG. 5, the paper web 9 passes from below in the upward direction through the first extended press nip between upper felt 11 and lower felt 13 and subsequently over the upper peripheral half of press unit 85 and through the second extended press nip from above in the downward direction together with lower felt 13. As shown in FIG. 6, paper web 9 passes through the first press nip between felts 11 and 13 from above in the downward direction, then over the lower peripheral half of unit 85 and from below in the upward direction through the second press nip with the upper felt.

The first press shoe 87 lies in a narrower pressure chamber than second press shoe 89. As a result the same pressurised fluid (with the same pressure) can be supplied to both pressure chambers via line 90. Nevertheless a lower pressing force will be produced—as normal—in the first press nip than in the second press nip.

We claim:

1. A press section of a paper making machine for dewatering a fibrous paper web, comprising:

two extended press nips disposed one behind the other in the direction of travel of the web;

the two extended press nips being formed by two respective press rolls and by a single flexible rotating press member, and two respective press shoes structured and arranged for pressing the rotating press member against the corresponding press rolls;

means for guiding said flexible press member to rotate over a substantially cylindrical path;

first and second endless felt belts which guide the paper web to be dewatered into the first extended press nip, the paper web being sandwiched between the two felt belts, said first felt belt being sandwiched between the paper web and the flexible rotating press member, and said second felt belt being sandwiched between the paper web and the first press roll;

wherein only said first endless felt belt guides the paper web to be dewatered into the second extended press nip;

wherein the single flexible press member has a rough outer surface; and wherein the press roll of the second extended press nip has a smooth, non-water-absorbent surface; and further comprising means for supplying lubricant to said two press shoes within said flexible rotating press member; and the flexible press member being constructed as an inflatable press jacket closed at the ends; thereby preventing any of said lubricant from escaping from within said press member.

2. A press section according to claim 1, structured and arranged so that the paper web passes through the second extended press nip between the first endless felt belt and the second press roll.

3. A press section according to claim 1, wherein, of the first and second felt belts passing through the first press nip, one is an upper felt belt and also passes through the second press nip.

4. A press section according to claim 1, structured and arranged so that the paper web passes substantially horizontally through the first press nip and, after a deflection of between approximately 90° and 160°, passes substantially from below in the upward direction through the second press nip.

5. A press section according to claim 1, characterised in that the respective directions in which the two press shoes press said flexible press member lie generally in the same plane.

6. A press section according to any one of claims 1, 4, and 5, wherein each said press shoe has a pressure chamber having means for receiving a hydraulic fluid for causing said press shoe to press said flexible press member, and, seen in cross section, the width along the direction of travel of the fibrous web of the pressure chamber of the first press shoe is less than the width of the pressure chamber of the second press shoe, and wherein said hydraulic fluid is supplied at the same pressure to both pressure chambers.

7. A press section according to claim 1, wherein the press shoe of the first extended press nip has, in the direction of travel of the web after the extended press nip, a substantially convexly curved guide surface, and said second felt belt, which in the first press nip contacts the first press roll, is passed through the first extended press nip so that, together with the first felt belt and the paper web, it passes firstly over at least part of the convexly curved guide surface and is subsequently separated from the paper web.

8. A press section according to claim 1, wherein, past the first press nip between the first press roll and the second felt belt there is disposed an air blast box, which assists the separation of the paper web from the second felt belt.

9. A press section according to claim 1, wherein at least one of the two press rolls is constructed as a flexure-adjusting roll.

10. A press section according to claim 1, wherein of the first and second felt belts passing through the first press nip, one is a lower felt belt and also passes through the second press nip.

* * * * *